United States Patent [19]

Peters

[11] Patent Number: 4,827,638

[45] Date of Patent: May 9, 1989

[54] ARTWORK SUPPORT APPARATUS

[76] Inventor: Gerald A. Peters, Box 1020, Carnegie, Okla. 73015

[21] Appl. No.: 142,481

[22] Filed: Jan. 6, 1988

[51] Int. Cl.[4] ..... D05C 1/04

[52] U.S. Cl. ..... 38/102.2; 223/107; 248/349; 312/125; 312/305; 211/129; 108/94; D3/25; D3/26

[58] Field of Search ..... 66/1 A, 187; 223/107, 223/106, 120, 108; 248/349; 312/125, 305; 211/129; 108/95, 94, 103; 38/102, 102.1, 102.2; D3/25, 26, 20

[56] References Cited

U.S. PATENT DOCUMENTS

| | | | |
|---|---|---|---|
| D. 46,807 | 12/1914 | Landahl | D3/25 |
| D. 217,321 | 4/1970 | Willner | 223/107 |
| D. 244,755 | 6/1977 | Bard | D15/66 |
| 244,816 | 7/1881 | Maxwell . | |
| 396,073 | 1/1889 | Cory . | |
| 406,119 | 7/1889 | White . | |
| 613,986 | 11/1898 | Godbury | 108/95 |
| 699,263 | 5/1902 | Vosler . | |
| 707,353 | 8/1902 | Post . | |
| 815,067 | 3/1906 | Commons | 223/106 |
| 816,077 | 3/1906 | Crawford | 108/94 |
| 966,929 | 8/1910 | Lang . | |
| 1,249,706 | 12/1917 | Zimmerman | 211/129 X |
| 1,700,666 | 1/1929 | Bright . | |
| 2,945,597 | 7/1960 | Romano | 108/94 |
| 3,297,372 | 1/1967 | Brader | 248/129 X |
| 3,464,648 | 9/1969 | Fuhriman | 108/94 X |
| 3,774,325 | 11/1973 | Johnson et al. | 38/102.2 |
| 3,855,718 | 12/1974 | Parsons et al. | 38/102.2 |
| 3,858,529 | 1/1975 | Salladay | 108/103 |
| 4,549,366 | 10/1985 | Gerding et al. | 38/102.2 |

*Primary Examiner*—Andrew M. Falik

*Attorney, Agent, or Firm*—Clifford C. Dougherty, III

[57] ABSTRACT

An apparatus for supporting a work article on a work surface. The apparatus includes a base member having an opening therein, a work article support member attached to and positioned above the base member, the work article support member having an opening therein positioned in at least partial alignment with the opening of the base member, and means attached to the base member and positioned between the base member and the work surface for allowing the base member and the work article support member to rotate with respect to the work surface. A storage tray having an opening positioned in at least partial alignment with the openings of the base member and the work article support member can be attached to the base member and positioned between the base member and the work article support member.

21 Claims, 2 Drawing Sheets

ARTWORK SUPPORT APPARATUS

BACKGROUND OF THE INVENTION

1. Field of the Invention

The present invention relates generally to apparatus for supporting a work article on a work surface, and more particularly, but not by way of limitation, to needlework hoops and apparatus for maintaining and supporting needlework equipment.

2. Background of the Invention

Needlework has been performed both professionally and as a hobby for many years by people all over the world. Forms of needlework include embroidery, knitting and needlepoint.

Embroidery can be defined as the art or process of forming decorative designs in plain or fancy stitches by hand or machine on cloth, leather, paper or other material. The art of embroidery, particularly punch embroidery, has become very popular in recent years. The development of various embroidery apparatus and methods such as electric punch embroidery machines and special stitching techniques have made embroidery faster and easier than ever before.

To perform embroidery and other forms of needlework, the article to be worked on is clamped between two annular rims that form a needlework hoop. The hoop serves to hold the work article taut as the work is performed. Thread, yarn or other stitching material is punched through the work article and lifted back out to form a series of loops. The work article eventually becomes covered with tiny stitches that form a design.

Typically, the artist holds the needlework hoop in one hand or on his or her lap as the work is performed. In order to follow a pattern, the artist must pick up and rotate the hoop as the stitches are made. The artist is often required to reach under the hoop to separate threads and the like.

Inasmuch as needlework involves many hours of very detailed work, most artists start and stop a particular project many times before it is completed. Many artists carry their work and needlework equipment with them wherever they go so that they can perform the work in their spare time.

To simplify the needlework process, many stands and other support apparatus for supporting the needlework hoop as the work is performed have been developed. For example, in U.S. Pat. No. 4,549,366, a stand for pivotally and rotatably supporting an embroidery hoop is disclosed. Most of the stands and other support apparatus developed heretofore hold the hoop in a position that allows the artist to reach both sides of the work article. The hoop can usually be rotated and tilted to almost any position. As a result, the needlework process is simplified in many respects.

Although the stands and other hoop support apparatus developed heretofore work very well, they cannot be used in all applications. They are too heavy and bulky to carry around from place to place or to use in confined areas such as in an automobile or on an airplane. Assembly, disassembly and storage of such stands and apparatus is often a major problem.

There is a need for simple and lightweight support apparatus that rigidly supports the needlework work article on any work surface, including the artist's lap. There is a need for such apparatus that can be easily assembled, disassembled, stored and transported from place to place with other needlework equipment. Such apparatus should allow full rotation of the work article while providing easy access to both sides thereof.

SUMMARY OF THE INVENTION

The present invention provides apparatus for supporting a work article on a work surface. The apparatus comprises a base member having an opening therein, a work article support member attached to and positioned above the base member, the work article support member having an opening therein positioned in at least partial alignment with the opening of the base member, and rotation means attached to the base member and positioned between the base member and the work surface for allowing the base member and the work article support member to rotate with respect to the work surface. The apparatus can include a storage tray attached to the base member and positioned between the base member and the work article support member, the storage tray having an opening therein positioned in at least partial alignment with the openings of the base member and the work article support member.

The work article support member can be attached to the base member by at least one leg member having a first end attached to the base member and a second end attached to the work article support member. The storage tray can be attached to the leg member. Preferably, the openings of the base member, the work article support member and the storage tray each have a diameter of at least three inches.

Spool receiving means can be attached to the storage tray for receiving and holding at least one spool of thread. The spool receiving means preferably comprise at least one spool stud having a first end attached to the storage tray and a second end for receiving a spool of thread, the second end of the spool stud being spaced no more than 1.5 inches from the work article support member.

In one embodiment, the work article support member comprises a needlework hoop. In another embodiment, the work article support member comprises means for receiving and supporting a needlework hoop in a position such that the opening defined by the inner periphery of the hoop is positioned in at least partial alignment with the openings defined by the base member and the work article support member.

From the foregoing description of the present invention, it will be apparent that an important object of the invention is to provide improved artwork support apparatus whereby the time and effort required to perform quality artwork is greatly reduced.

A further object of the invention is to provide simple and lightweight needlework support apparatus that will rigidly support the needlework work article on any work surface, including the artist's lap.

A further object of the present invention is to provide simple and lightweight needlework support apparatus that can be easily assembled, disassembled, stored and transported from place to place with other needlework equipment.

A further object of the present invention is to provide needlework support apparatus that allow full rotation of the work article while providing access to both sides thereof and that are durable, easy to manufacture and easy to package.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
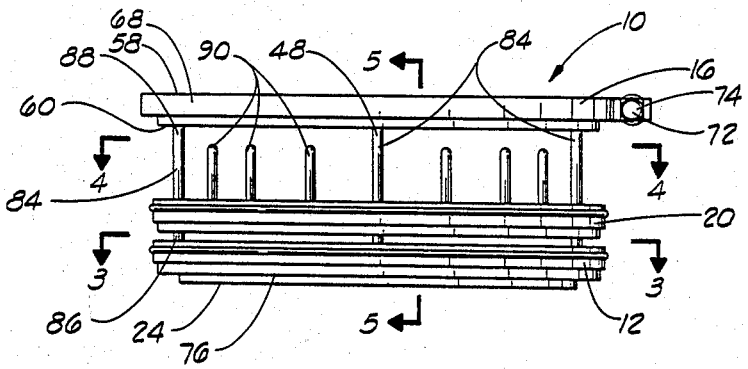
FIG. 1 is a front elevational view of the artwork support apparatus of the present invention.

The present invention provides apparatus for supporting a work article on a work surface. Although the apparatus can be used to support all types of work articles, including those associated with the arts of carving and painting, the preferred embodiments of the apparatus ae particularly designed to support work articles associated with embroidery and other needlework art.

Referring now to the drawings, and particularly to FIGS. 1-5, a first embodiment of the apparatus of the present invention is illustrated and generally designated by the numeral 10. The apparatus 10 is used to support a work article (not shown) on a work surface (not shown). The work surface can be a desk, a table, the ground, the artist's lap or any other surface on which work can be performed.

Figure 5:
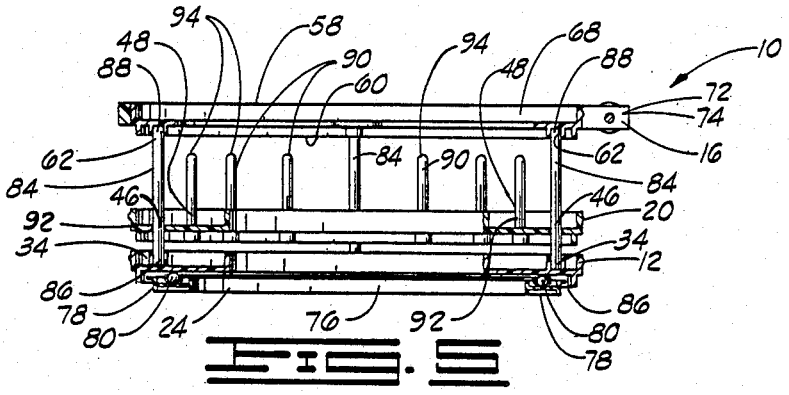
FIG. 5 is a cross-sectional view of the artwork support apparatus of the present invention, taken along line 5—5 of FIG. 1.

The apparatus 10 comprises a base member 12 having an opening 14 therein and a work article support member 16 attached to and positioned above the base member, the work article support member having an opening 18 therein positioned in at least partial alignment with the opening of the base member. A removable storage tray 20 is attached to the base member 12 and positioned between the base member and the work article support member 16. The storage tray 20 has an opening 22 therein positioned in at least partial alignment with the openings 14 and 18 of the base member 12 and the work article support member 16, respectively. Rotation means 24 in the form of a ball bearing assembly 76 are attached to the base member 12 and positioned between the base member and the work surface for allowing the base member and the work article support member 16 to rotate about the vertical axis of the apparatus 10 with respect to the work surface. As best shown in FIG. 5, the ball bearing assembly 76 includes a track or race 78 having a plurality of loose hard balls 80 disposed therein. For purposes of the description herein and in the appendant claims, terms such as upper, above, lower, below, vertical, horizontal and the like relate to the invention as it is oriented in FIG. 1 of the drawings.

Although they can exist in any shape, the base member 12, work article support member 16 and storage tray 20 are preferably annular in shape. The annular base member 12, annular work article support member 16 and annular storage tray 20 are preferably positioned approximately coaxially one above the other. In other words, the openings 14, 18 and 22 are preferably approximately concentric.

Figure 3:
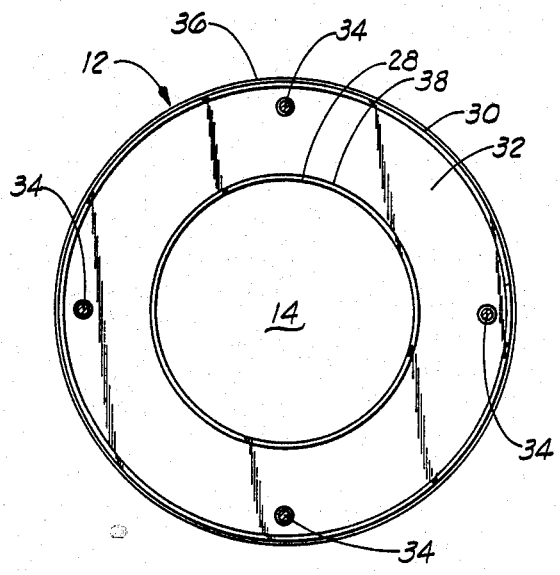
FIG. 3 is a cross-sectional view of the artwork support apparatus of the present invention, taken along line 3—3 of FIG. 1.

The annular base member 12 has an inner periphery 28, an outer periphery 30 and a periheral surface 32 defined by the inner periphery 28 and the outer periphery 30. The inner periphery 28 also defines the opening 14. As best shown in FIG. 3, the peripheral surface 32 includes a plurality of recesses 34 defined therein. The function of the recesses 34 will be described below. An outer peripheral rim 36 is disposed on the peripheral surface 32 around the outer periphery 30 thereof. An inner peripheral rim 38 is disposed on the peripheral surface 32 around the inner periphery 28 thereof. The peripheral rims 36 and 38 allow the peripheral surface 32 of the base member 12 to be used for storage. They prevent items stored on the peripheral surface 32 from sliding off the same.

Figure 4:
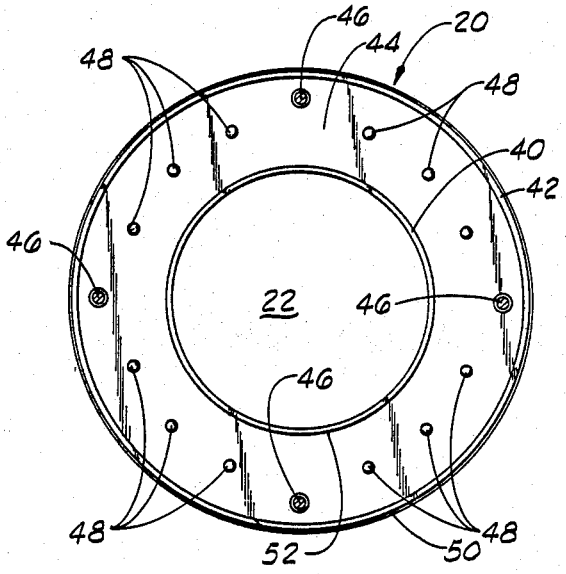
FIG. 4 is a cross-sectional view of the artwork support apparatus of the present invention, taken along line 4—4 of FIG. 1.

As best shown in FIG. 4, the annular storage tray 20 includes an inner periphery 40, an outer periphery 42 and a peripheral surface 44 defined by the inner periphery 40 and the outer periphery 42. The peripheral surface 44 includes a plurality of openings 46 and a plurality of recesses 48 defined therein. The function of the openings 46 and the recesses 48 will be described below. An outer peripheral rim 50 is disposed on the peripheral surface 44 around the outer periphery 42 thereof. An inner peripheral rim 52 is disposed on the peripheral surface 44 around the inner periphery 40 thereof. The rims 50 and 52 prevent items stored on the annular storage tray 20 from falling off the same.

Figure 2:
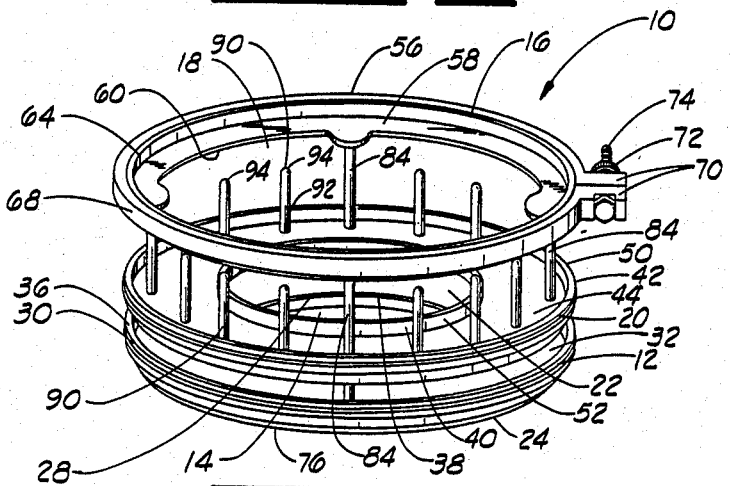
FIG. 2 is a perspective view of the artwork support apparatus of the present invention.

As best shown in FIGS. 2 and 5, the work article support member 16 has an inner periphery 54, an outer periphery 56 and a peripheral surface 58 defined by the inner periphery 54 and the outer periphery 56. A surface 60 opposite the peripheral surface 58 of the work article support member 16 includes a plurality of recesses 62 defined therein. The function of the recesses 62 will be described below. A first annular rim 64 is disposed on the peripheral surface 58 around the outer periphery 56 thereof. A second annular rim 68 is removably disposed around the first annular rim 64. The second annular rim 68 is secured to the first annular rim 64 by two opposing plates 70 and fastening means 72. To remove the second annular rim 68 from the first annular rim 64, the plates 70 are separated to separate the second annular rim so that it can be pulled off the first annular rim. The fastening means 72 preferably comprise a thumb screw assembly 74.

The first annular rim 64, second annular rim 68, plates 70 and thumb screw assembly 74 form a needlework or embroidery hoop. The portion of the work article to be worked on is clamped between the first and second annular rims 64 and 68 and held taut thereby as the work is performed.

It is important for the openings 14, 18 and 22 to be in at least partial alignment. This allows the artist to reach through the openings 14, 18 and 22 to the bottom side of the portion of the work article held taut by the hoop in order to separate threads and the like. In order to assure that the artist's hand will fit through the openings 14, 18 and 22, the openings ar preferably approximately concentric and preferably have a diameter of at least three inches.

As best shown in FIGS. 1, 2 and 5, the work article support member 16 and the storage tray 20 are attached to the base member 12 by a plurality of columns 84, each column having a first end 86 attached to the annular base member and a second end 88 attached to the annular work article support member. Each column 84 extends from a corresponding recess 34 in the peripheral surface 32 of the annular base member 12 through a corresponding opening 46 in the peripheral surface 44 of the storage tray 22 to a corresponding recess 62 in the surface 60 of the work article support member 16.

Although the first and second ends 86 and 88 of the columns 84 fit snugly into the recesses 34 and the recesses 62, respectively, to hold the apparatus 10 together, the annular base member 12 and the work article support member 16 can be easily removed from the columns 84 by simply pulling them therefrom. This arrangement allows the storage tray 20 to be easily removed and the entire apparatus 10 to be easily disassembled. Once either the work article support member 16 or the base member 12 is removed from the columns 84, the storage tray 20 can be removed from the columns by simply sliding it therefrom. The work article support member 16 can be used by itself, or in connection with the base member 14 and the storage tray 20. The apparatus can be used with or without the storage tray 20 attached thereto.

Means for receiving and holding at least one spool of thread in the form of a plurality of spool studs 90 are attached to the peripheral surface 44 of the storage tray 20. Each spool stud 90 has a first end 92 attached to the peripheral surface 44 of the storage tray 20 and a second end 94 for receiving a spool of thread. The spool studs 90 fit within the openings in spools of thread. The second ends 94 of the spool studs 90 are preferably spaced no more than 1.5 inches, preferably 1.0 inch, from the surface 60 of the work article support member 16. This prevents the spools of thread from sliding off the spool studs 90, even when the apparatus 10 is turned upside down. To place spools of thread on the spool studs 90 or to remove spools of thread therefrom, the work article support member 16 must be removed from the columns 84.

In operation of the apparatus 10, the second annular rim 68 of the work article support member 16 is removed from the first annular rim 64 thereof. A portion of the work article to be worked on is placed over the first annular rim 64. The second annular rim 68 is then positioned around the first annular rim 64 and tightened until the work article is held taut. The apparatus 10 is positioned on a work surface such as a table or the artist's lap where it can be rotated as the embroidery work is performed. If the artist needs access to the bottom side of the work article, he or she can pick the apparatus 10 up and reach through the openings 14, 18 and 22. If the storage tray is removed from the apparatus 10, it may not be necessary to pick the apparatus up.

Needles, needle threaders, spools of thread and other equipment can be stored on both the peripheral surface 32 of the base member 12 and the peripheral surface 44 of the storage tray 20. The apparatus 10 and equipment stored thereon can be easily transported from place to place.

Figure 6:
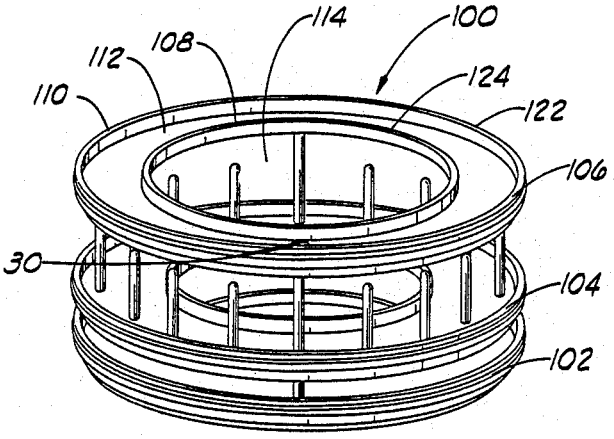
FIG. 6 is a perspective view of an alternate embodiment of the artwork support apparatus of the present invention.
Figure 7:
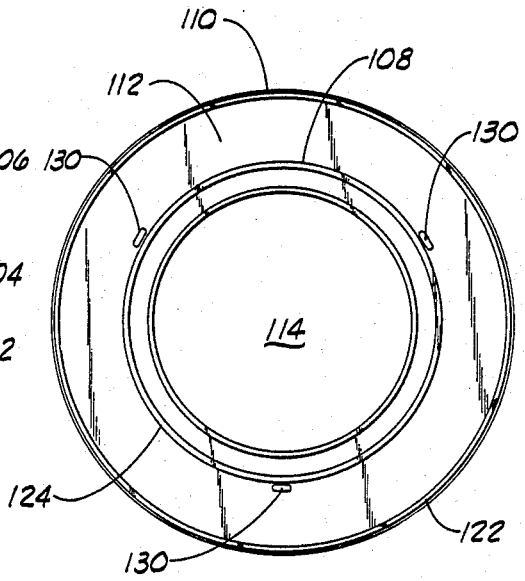
FIG. 7 is a top view of the apparatus shown in FIG. 6.
Figure 8:
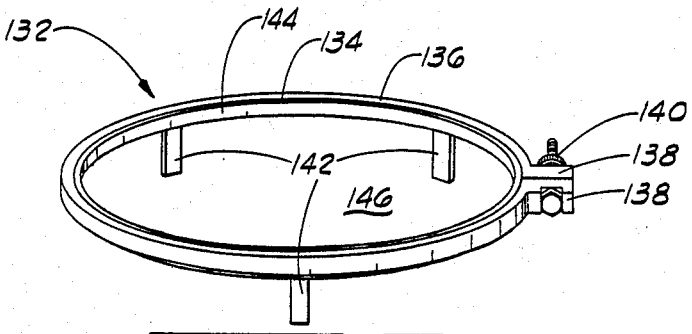
FIG. 8 is a perspective view of an embroidery hoop that can be used in conjunction with the artwork support apparatus shown in FIGS. 6 and 7.

Referring now to FIGS. 6–8, an alternate embodiment of the apparatus of the present invention is illustrated and generally designated by the numeral 100. Like the apparatus 10, the apparatus 100 includes a base member 102, a storage tray 104, a work article support member 106, a plurality of columns connecting the base member, storage tray and work article support member together and means attached to the base member and positioned between the base member and the work surface for allowing the base member, storage tray and work article support member to rotate with respect to the work surface. Except for the work article support member 106, the apparatus 100 is identical to the apparatus 10. A detailed description of all of the individual parts and features of the apparatus 100 is not repeated. Only the differences between the apparatus 100 and the apparatus 10 are described.

The work article support member 106 of the apparatus 100 comprises an inner periphery 108, an outer periphery 110 and a peripheral surface 112 defined by the inner periphery 108 and the outer periphery 110. The inner periphery 108 also defines an opening 114. Preferably, the opening 114 is approximately concentric with the openings of the base member and the storage tray and has a diameter of at least three inches. Like the surface 60 of the work article support member 16 of the apparatus 10, the surface (not shown) opposite the peripheral surface 112 of the work article support member 106 includes a plurality of recesses (not shown) for receiving the second ends of the columns.

An outer peripheral rim 122 is disposed on the peripheral surface 112 of the work article support member 106 around the outer periphery 110 thereof. An inner peripheral rim 124 is disposed on the peripheral surface 112 of the work article support member 106 around the inner periphery 108 thereof. The peripheral rims 122 and 124 prevent items stored on the peripheral surface 112 of the work article support member 106 from sliding off the same.

Instead of comprising a needlework hoop, the work article support member 106 includes means for receiving and supporting a needlework hoop in a position such that the opening defined by the inner periphery of the hoop is positioned in at least partial alignment with the opening 114. Preferably, the means for receiving and supporting a needlework hoop includes three slots 130 disposed in the peripheral surface 112 of the work article support member 106.

In FIG. 8, a hoop of a type commonly sold today is illustrated and generally designated by the numeral 132. The hoop 132 includes an inner annular rim 134, an outer annular rim 136, a pair of plates 138 connected to the outer annular rim, a thumb screw assembly 140 and a three leg member 142. The inner annular rim 134 includes an inner periphery 144 which defines an opening 146.

The slots 130 defined in the peripheral surface 112 of the work article support member 106 of the apparatus 100 are designed to receive the leg members 142 of the hoop 132. The leg members 142 are held in corresponding slots 130 to support the hoop 132 in a position such that the opening 146 defined by the inner periphery 144 thereof is positioned in at least partial alignment with the opening 114 of the work article support member 106.

Preferably, the hoop 132 is supported in a position such that the opening 146 thereof is approximately concentric with the opening 114 of the work article support member 106. This allows the artist to gain access to the bottom of the portion of the work article held by the hoop 132 by reaching through the openings in the base member 102, storage tray 104 and work article support member 106.

The work article support member 106 can be modified to receive and support all types and sizes of needlework hoops.

In operation of the apparatus 100, a portion of the work article to be worked on is clamped between the annular rims 134 and 136 of the hoop 132. The leg members 142 of the hoop 132 are then positioned in the slots 130 defined in the peripheral surface 112 of the work article support member 106. The apparatus 100 is then operated in the same way that the apparatus 10 is operated.

Thus, the apparatus of the present invention simplify the needlework or embroidery process by reducing the amount of time and effort required to perform quality work. The artist is able to rotate the needlework hoop even though it is rigidly held on a work surface. This enables the work to be performed much easier and better than it can be performed by merely holding the hoop by hand.

Inasmuch as the apparatus of the present invention can be used to store and carry needlework equipment and allows quality needlework to be performed, it provides a self contained needlework kit. Needles, needle threaders, spools of thread and other needlework equipment can be stored on the apparatus. The apparatus is durable and lightweight, and can be easily assembled, disassembled, stored, and transported from place to place.

The base member, storage tray and work article support member, as well as all of the openings and recesses thereof, can be in any shape or form. Both embodiments of the apparatus of the present invention can be modified to accommodate all types and sizes of hoops.

The apparatus of this invention is well adapted, therefore, to carry out the objects and attain the ends and advantages mentioned as well as those inherent therein. While two presently preferred embodiments are described in this disclosure, numerous changes in the construction and arrangement of parts will suggest themselves to those skilled in the art. Such changes are encompassed within the spirit of this invention as defined in the appended claims.

What is claimed is:

1. Apparatus for supporting a work article on a work surface, comprising:

a base member having an centrally located opening therein;

a work article support member opsitioned above said base member, said work article support member having an opening therein positioned in at least partial alignment with said opening of said base member, said opening of said base member and said work article support member having diameters of at least three inches;

at least one column having a first end attached to said base member and a second end attached to said work article support member; and means attached to said base member and positioned between said base member and said work surface for allowing said base member and said work article support member to rotate with respect to said work surface.

2. The apparatus of claim 1, further comprising a storage tray attahced to said column and positioned between said base member and said work article support member, said storage tray having an opening therein positioned in at least partial alignment with said openings of said base member and said work article support member, said openings of said base member, storage tray and work article support member having diameters of at least three inches.

3. The apparatus of claim 2, further comprising spool receiving means attached to said storage tray for receiving and holding at least one spool of thread.

4. Apparatus for supporting a work article on a work surface, comprising:

a base member having an opening therein;

a work article support member attached to and positioned above said base member, said work article support member having an opening therein positioned in at least partial alignment with said opening of said base member and being attached to said base member by at least one column having a first end attached to said base member and a second end attached to said work article support member;

a storage tray attached to said column and positioned between said base member and said work article support member, said storage tray having an opening therein positioned in at least partial alignment with said openings of said base member and said work article support member;

at least one spool stud attached to said storage tray for receiving and holding at least one spool of thread having a first end attached to said storage tray and a second end for receiving a spool of thread, said second end of said spool stud being spaced no more than 1.5 inches from said work article support member; and means attached to said base member and positioned between said base member and said work surface for allowing said base member, said storage tray and said work article support member to rotate with respect to said work surface.

5. Apparatus for supporting a work article on a work surface, comprising:

an annular base member having an inner periphery, an outer periphery and a peripheral surface defined thereby, said inner pheriphery defining an opening;

an annular work article support member positioned above said annular base member, said annular work article support member having an inner periphery, an outer periphery and a peripheral surface defined thereby, said inner periphery defining an opening positioned in at least partial alignment with said opening defined by said inner periphery of said annular base member, said openings defined by said inner periphery of said annular base member and said inner periphery of said annular work article support member having diameters of at least three inches;

at least one column having a first end attached to said annular base member and a second end attached to said annular work article support member; and means attached to said annular base member and positioned between said annular base member and said work surface for allowing said annular base member and said annular work article support member to rotate with respect to said work surface.

6. The apparatus of claim 5 further comprising an annular storage tray attached to said column and positioned between said annular base member and said annular work article support member, said annular storage tray having an inner periphery, an outer periphery and a peripheral suface defined thereby, said inner periphery defining an opening positioned in at least partial alignment with said openings defined by said inner peripheries of said annular base member and said annular work article support member.

7. The apparatus of claim 6 wherein said annular base member, said annular storage tray and said annular work article support member are positioned approximately coaxially one above the other.

8. The apparatus of claim 7 wherein said openings defined by said inner periphery of said annular storage tray has a diameter of at least three inches.

9. The apparatus of claim 6 wherein said annular work article support member comprises at least one slot for receiving and supporting a needlework hoop in a position such that the opening defined by the inner periphery of said hoop is positioned in at least partial alignment with the opening defined by said inner periphery of said annular work article support member.

10. The apparatus of claim 9, further comprising means attached to said storage tray for receiving and holding at least one spool of thread.

11. Apparatus for supporting a work article on a work surface, comprising:

an annular base member having an inner periphery, an outer periphery and a peripheral surface defined thereby, said inner periphery defining an opening;

a neelework hoop positioned above said annular base member, said needlework hoop having an inner periphery, an outer periphery and a peripheral surface defined thereby, said inner periphery defining an opening positioned in at least partial alignment with said opening defined by said ineer pheriphery of said annular base member;

at least one column having a first end attached to said annular base member and a second end attached to said needlework hoop;

an annular storage tray attached to said column and positioned between said annular base member and said needlework hoop, said annular storage tray having an inner periphery, an outer periphery and a peripheral surface difined thereby, said inner periphery defining an opening positioned in at least partial alignment with said openings defined by said inner peripheries of said annular base member and said needlework hoop; and means attached to said annular base member and positioned between said annular base member and said work surface for allowing said annular base member, said storage tray and said needlework hoop to rotate with respect to said work surface.

12. The apparatus of claim 11, further comprising means attached to said storage tray for receiving and holding at least one spool of thread.

13. The apparatus of claim 12 wherein said means attached to said storage tray for receiving and holding at least one spool of thread comprises at least one spool stud having a first end attached to said annular storage tray and a second end for receiving a spool of thread, said second end of said spool stud being spaced no more than 1.5 inches from said annular work article support member.

14. Apparatus for supporting a work article on a work surface, comprising:

an annular base member having an inner periphery, an outer periphery and a peripheral surface defined thereby, said inner periphery defining an opening;

an annular work article support member positioned above said annular base member, said annular work article support member having an inner periphery, an outer periphery and a peripheral surface defined thereby, said inner periphery defining an opening positioned in at least partial alignment with said opening defined by said inner periphery of said annular base member, said annular work article support member comprising:

means for receiving and supporting a needlework hoop in a position such that the opening defined by the inner periphery of said hoop is positioned in at least partial alignment with the opening defined by said inner periphery of said annular work article support member;

a least one column having a first end attached to said annular base member and a second end attached to said annular work article support member;

an annular storage tray attached to said column and positioned between said annular base member and said annular work article support member, said annular storage tray having an inner periphery, an outer periphery and a peripheral surface defined thereby, said inner periphery defining an opening positioned in at least partial alignment with said openings defined by said inner peripheries of said annular base member and said annular work article support member at least one spool stud attached to said storage tray for receiving and holding at least one spool of thread having a first end attached to said annular storage tray and a second end for receiving a spool of thread, said second end of said spool stud being spaced no more than 1.5 inches from said annular work article support member; and means attached to said annular base member and positioned between said annular base member and said work surface for allowing said annular base member, said annular storage tray and said work article support member to rotate with respect to said work surface.

15. An apparatus for supporting a work article on a work surface, comprising:

an annular base member having an inner periphery, an outer periphery an a peripheral surface defined thereby, said inner periphery defining an opening having a diameter of at least three inches;

an annular storage tray positioned approximately coaxially above said annular base member, said annular storage tray having an inner periphery, an outer periphery and a peripheral surface defined thereby, said inner periphery defining an opening having a diameter of at least three inches and said peripheral surface having at least one opening therein;

an annular work article support member positioned approximately coaxially above said annular storage tray said annular work artcle support member having an inner periphery, an outer periphery and a peripheral surface defined thereby, said inner periphery having a diameter of at least three inches;

at least one column extending from said annular base member through said opening in said peripheral surface of said annular storage tray to said annular work article support member, said column having a first end attached to said annular base member and a second end removably attached to said annular work article support member whereby said annular storage tray and said annular work article support member can be removed from said annular base member; and rotation means attached to said annular base member and positioned between said annular base member and said work surface for allowing said annular base member, said annular storage tray and said annular work article support member to rotate with respect to said work surface.

16. The apparatus of claim 15 wherein said annular work article support member comprises a needlework hoop.

17. The apparatus of claim 16, further comprising means attached to said annular storage tray for receiving and holding at least one spool of thread.

18. The apparatus of claim 17 wherein said means attached to said annular storage tray for receiving and holding at least one spool of thread comprises at least one spool stud having a first end attahced to said peripheral surface of said annular storage tray and a second end for receiving a spool of thread, said second end of said spool stud being spaced no more than 1.5 inches from said annular work article support member.

19. The apparatus of claim 16, further comprising means attached to said annular storage tray for receiving and holding at least one spool of thread.

20. The apparatus of claim 19 wherein said means attached to said inner storage tray for receiving and holding at least one spool of thread comprises at least one spool stud having a first end attached to said peripheral surface of said annular storage tray and a second end for receiving a spool of thread, said second end of said spool stud being spaced no more than 1.5 inches from said annular work article support member.

21. The apparatus of claim 15 wherein said annular work article support member comprises means for receiving and supporting a needlework hoop in a position such that said hoop is positioned approximately coaxially thereabove.

* * * * *

UNITED STATES PATENT AND TRADEMARK OFFICE

CERTIFICATE OF CORRECTION

PATENT NO. : 4,827,638

DATED : May 9, 1989

INVENTOR(S) : Gerald A. Peters

It is certified that error appears in the above-identified patent and that said Letters Patent is hereby corrected as shown below:

(1) Column 3, line 34, delete "ae" and insert --are--;

(2) Column 4, line 10, delete "periheral" and insert --peripheral--;

(3) Column 4, line 68, delete "ar" and insert --are--;

(4) Column 7, line 48, delete "an" and insert --a--;

(5) Column 7, line 50, delete "opsitioned" and insert --positioned--;

(6) Column 7, line 54, delete "opening" and insert --openings--;

(7) Column 9, line 9, delete "openings" and insert --opening--;

(8) Column 9, line 27, delete "neelework" and insert --needlework--;

(9) Column 9, line 32, delete "ineer" and insert --inner--;

(10) Column 10, line 26, insert --;-- after "member";

(11) Column 10, line 43, delete "an" and insert --and--; and

(12) Column 11, line 18, delete "attahced" and insert --attached--.

Signed and Sealed this

Twenty-fourth Day of October, 1989

*Attest:*

*Attesting Officer*

DONALD J. QUIGG

*Commissioner of Patents and Trademarks*